US010001131B2

(12) United States Patent
Chiba et al.

(10) Patent No.: US 10,001,131 B2
(45) Date of Patent: Jun. 19, 2018

(54) WATER PUMP

(71) Applicant: AISIN SEIKI KABUSHIKI KAISHA, Kariya-shi, Aichi-ken (JP)

(72) Inventors: Atsushi Chiba, Toyoake (JP); Kazuma Sasanami, Kariya (JP); Kenichi Komai, Toyota (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 462 days.

(21) Appl. No.: 14/861,535

(22) Filed: Sep. 22, 2015

(65) Prior Publication Data

US 2016/0084259 A1 Mar. 24, 2016

(30) Foreign Application Priority Data

Sep. 24, 2014 (JP) ..... 2014-194419
Sep. 7, 2015 (JP) ..... 2015-175847

(51) Int. Cl.

| | |
|---|---|
| ***F04D 29/08*** | (2006.01) |
| ***F04D 29/42*** | (2006.01) |
| ***F01P 5/12*** | (2006.01) |
| ***F02B 75/22*** | (2006.01) |

(52) U.S. Cl.

CPC ..... *F04D 29/086* (2013.01); *F01P 5/12* (2013.01); *F02B 75/22* (2013.01); *F04D 29/4293* (2013.01)

(58) Field of Classification Search

CPC ..... F04D 29/086; F04D 29/4293; F01P 5/12; F02B 75/22

See application file for complete search history.

(56) References Cited

U.S. PATENT DOCUMENTS 6,793,459 B2 * 9/2004 Chujo ..... F01P 5/10 415/213.1

FOREIGN PATENT DOCUMENTS

JP 2003-269165 A 9/2003

* cited by examiner

*Primary Examiner* — Richard Edgar

(74) *Attorney, Agent, or Firm* — Buchanan Ingersoll & Rooney PC

(57) ABSTRACT

A water pump includes an impeller, a whirl chamber, a pump body including the impeller and the whirl chamber, a cover case portion and a gasket portion being positioned between the pump body and the cover case portion. The cover case portion is formed with an inlet flow passage in which a fluid is introduced to the whirl chamber and an outlet flow passage in which the fluid is discharged from the whirl chamber. The gasket portion is formed with an inlet hole opening from the whirl chamber to the inlet flow passage and an outlet hole opening from the whirl chamber to the outlet flow passage. The gasket portion includes a portion covering at least one of the inlet flow passage and the outlet flow passage in a state where the portion of the gasket portion is exposed by not being in contact with the pump body.

7 Claims, 8 Drawing Sheets

WATER PUMP

CROSS REFERENCE TO RELATED APPLICATIONS

This application is based on and claims priority under 35 U.S.C. § 119 to Japanese Patent Application 2014-194419, filed on Sep. 24, 2014, the entire content of which is incorporated herein by reference.

TECHNICAL FIELD

This disclosure generally relates to a water pump.

BACKGROUND DISCUSSION

A known water pump is disclosed in JP2003-269165A (hereinafter referred to as Patent reference 1). According to the water pump disclosed in Patent reference 1, a plate-shaped gasket is positioned so as to be sandwiched by a pump body and a fixed member (a cylinder block). The gasket includes an intermediate plate (a separator) and two sheets of metal gaskets. The intermediate plate having a high rigidity separates the pump body from the fixed member to form an inlet space and an outlet space. The respective metal gaskets are positioned at front and back surfaces of the intermediate plate in order to prevent water from leaking to a portion between the pump body and the intermediate plate and to a portion between the fixed member and the intermediate plate.

The intermediate plate includes an inlet opening portion and a supply opening portion. The inlet opening portion in which water supplied from a radiator of an internal combustion engine introduced to an inlet flow passage. The supply opening portion in which the water stored in the inlet flow passage is introduced to the outlet space. An outer rim portion of the intermediate plate is fixed to the pump body and the cover case portion so as to be sandwiched by the pump body and the cover case portion.

According to the water pump disclosed in Patent reference 1, in a case where, for example, a V-engine is mounted to a vehicle, cool water is supplied to two positions that are apart from each other. In this case, an outlet flow passage extends from each of one end and the other end of the pump body to an outside. Because the outlet flow path is covered with the pump body, a space for the pump body comes to be upsized and accordingly, the water pump tends to be upsized. Accordingly, the weight of the water pump increases, resulted in the reduction of the fuel consumption and the high cost of the water pump.

A need thus exists for a water pump which is not susceptible to the drawback mentioned above.

SUMMARY

According to an aspect of this disclosure, a water pump includes an impeller being rotary driven, a whirl chamber containing the impeller, a pump body including the impeller and the whirl chamber, a cover case portion being attached to the pump body so as to face therewith, and a gasket portion being positioned between the pump body and the cover case portion. The cover case portion is formed with an inlet flow passage in which a fluid is introduced to the whirl chamber. The cover case portion is formed with an outlet flow passage in which the fluid is discharged from the whirl chamber. The gasket portion is formed with an inlet hole opening from the whirl chamber to the inlet flow passage.

The gasket portion is formed with an outlet hole opening from the whirl chamber to the outlet flow passage. The gasket portion includes a portion covering at least one of the inlet flow passage and the outlet flow passage in a state where the portion of the gasket portion is exposed by not being in contact with the pump body.

According to another aspect of this disclosure, a water pump includes an impeller being rotary driven, a whirl chamber containing the impeller, a pump body including the impeller and the whirl chamber, a chain cover being attached to the pump body so as to face therewith, and a gasket portion being positioned between the pump body and the chain cover. The chain cover is formed with an inlet groove portion in which a fluid is introduced to the whirl chamber. The chain cover is formed with an outlet groove portion in which the fluid is discharged from the whirl chamber. The gasket portion is formed with an inlet hole opening from the whirl chamber to the inlet groove portion. The gasket portion is formed with an outlet hole opening from the whirl chamber to the outlet groove portion. The gasket portion includes a portion covering at least one of the inlet groove portion and the outlet groove portion in a state where the portion of the gasket portion is exposed by not being in contact with the pump body.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of this disclosure will hereunder be explained with reference to the drawings.

Figure 1:
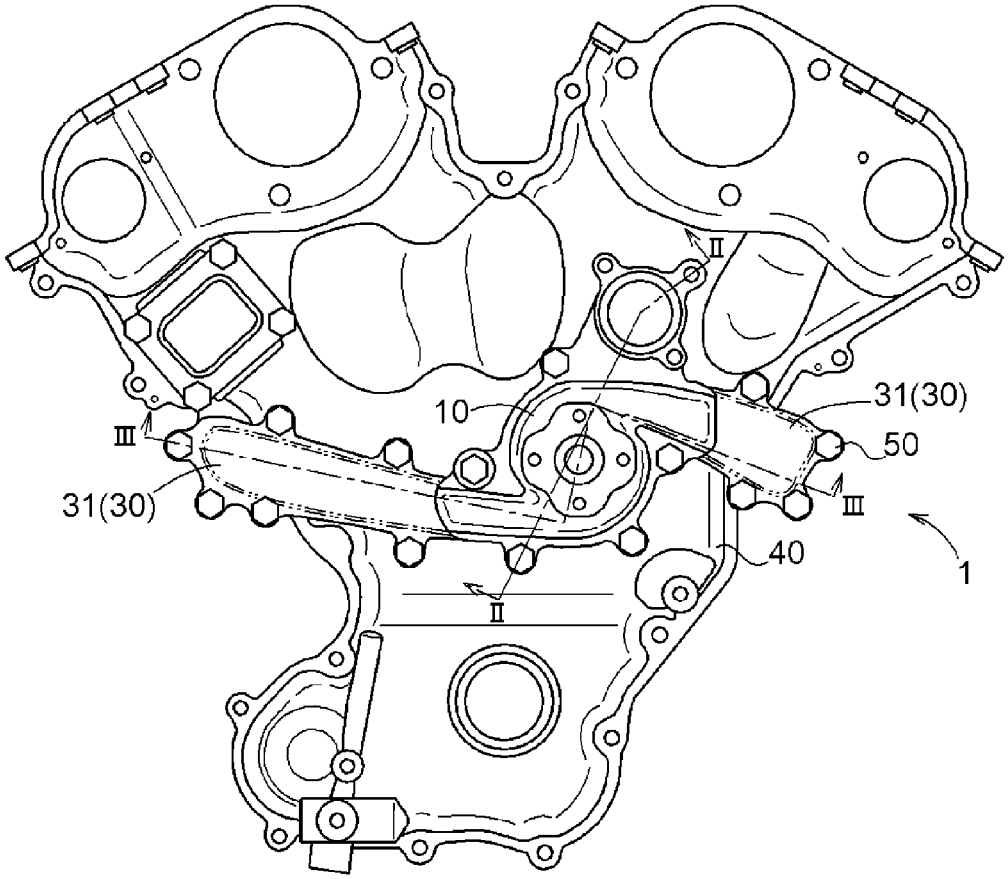
FIG. 1 is a front view of a water pump according to a first embodiment disclosed here.
Figure 2:
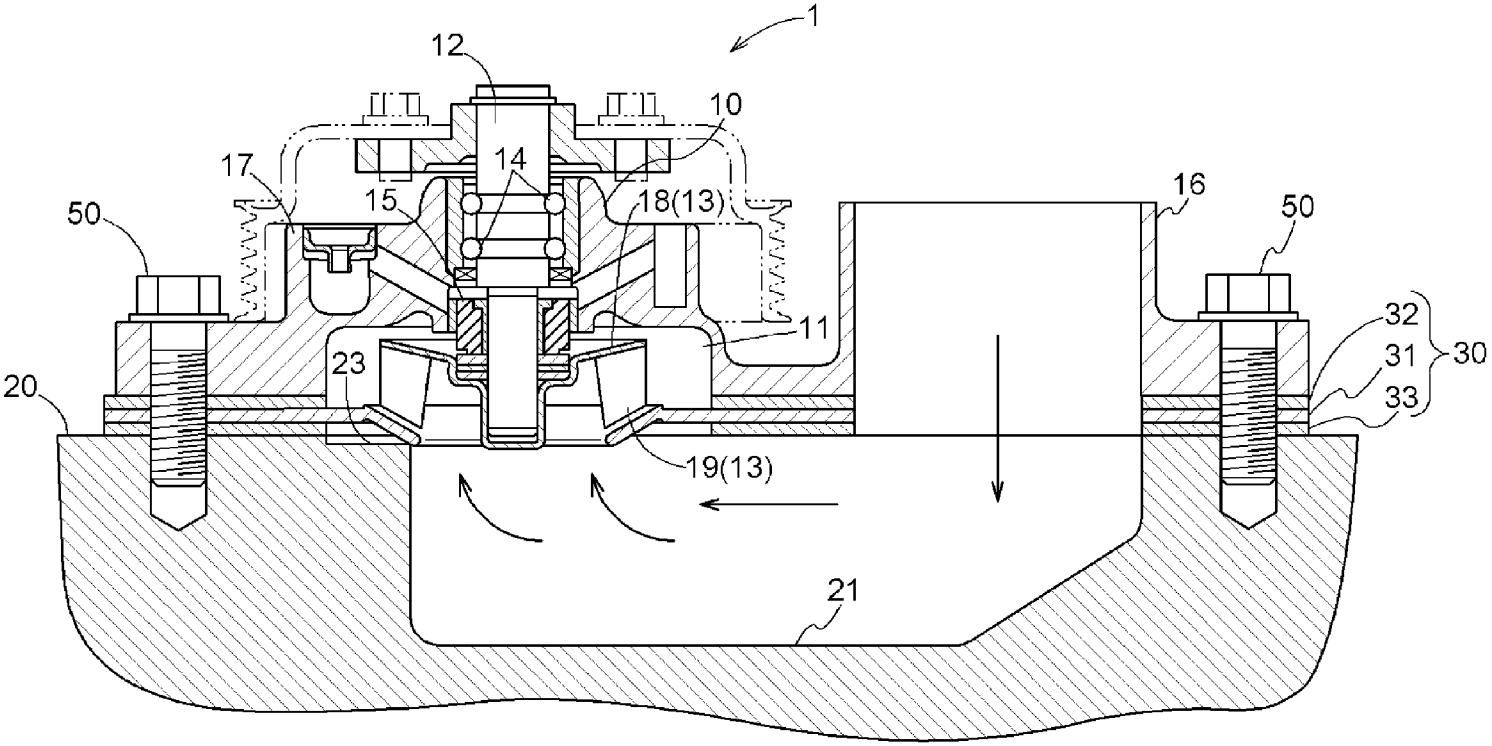
FIG. 2 is a cross sectional view taken along line II-II in FIG. 1 seen in a direction of an arrow.
Figure 3:
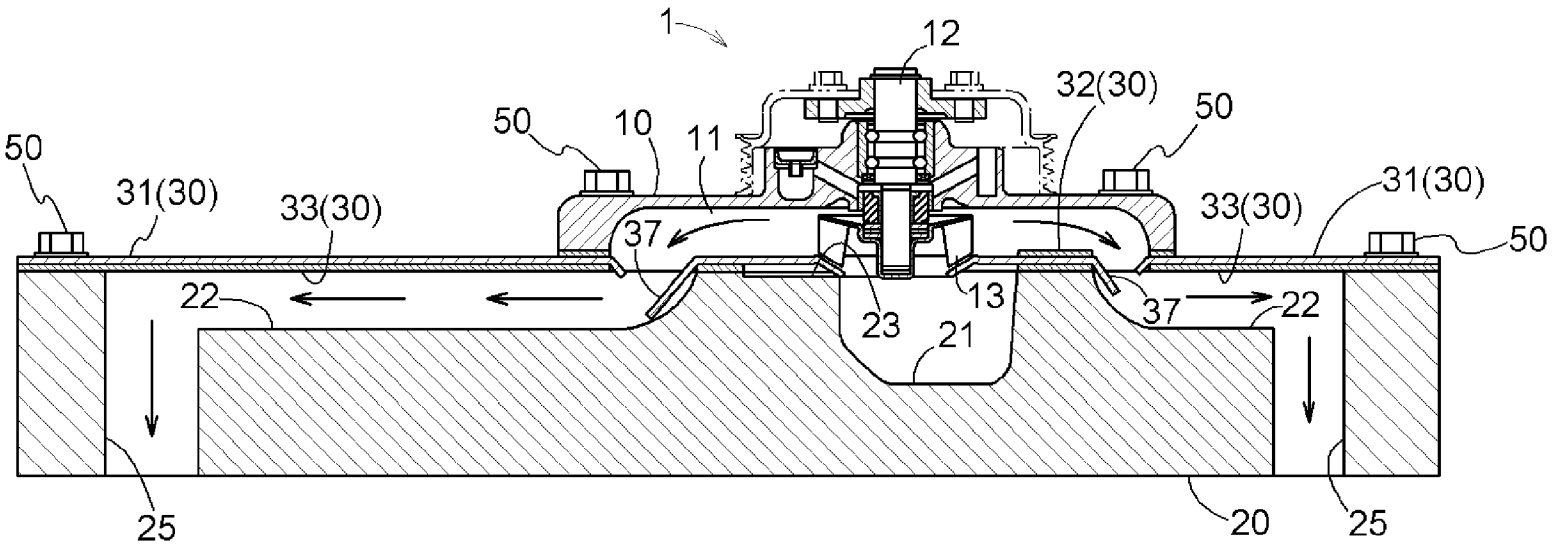
FIG. 3 is a cross sectional view taken along line III-III in FIG. 1 seen in a direction of an arrow.

A first embodiment will be explained. FIGS. 1 to 7 show an example of a water pump according to this disclosure, the water pump being mounted on a V-engine. As shown in FIGS. 1 to 3, a water pump 1 includes a pump body 10, a cover case portion 20 and a gasket portion 30. The cover case portion 20 is positioned so as to face the pump body 10. The gasket portion 30 is positioned between the pump body 10 and the cover case portion 20. The pump body 10 includes a whirl chamber 11 and an impeller 13. The whirl chamber 11 opens to a side where the cover case portion 20 is positioned. The impeller 13 is contained in the whirl chamber 11 while being attached to a first end of a drive shaft 12. The cover portion 20 is configured by a portion of a chain cover 40 (see FIG. 1) of the engine.

The drive shaft 12 of the pump body 10 is rotatably supported with, for example, a ball bearing 14 and is rotary driven by a motive power of a crank shaft of the engine. A mechanical seal 15 liquid-tightly sealing the whirl chamber 11 is positioned between the ball bearing 14 and the impeller 13.

As shown in FIG. 3, the cover case portion 20 is provided with an inlet flow passage 21 (i.e., serving as an inlet groove portion) and an outlet flow passage 22 (i.e., serving as an outlet groove portion). The pump body 10 is positioned so as to face the inlet flow passage 21. The pump body 10 is mounted to a plane portion 23 that serves as a periphery of the inlet flow passage 21 and to a portion of a bolt mounted portion 24 (see FIG. 5). The outlet flow passage 22 is covered with the gasket portion 30. As shown in FIGS. 1 and 3, the gasket portion 30 extends in a direction along the outlet flow passage 22 relative to the pump body 10 and covers the outlet flow passage 22.

As shown in FIG. 2, the pump body 10 is integrally formed with a tubular portion 16 that guides fluid (water) sent, or flown from, for example, a radiator, to the inlet flow passage 21. The fluid (water) supplied from the tubular portion 16 flows in the inlet flow passage 21 and is introduced to a side where the impeller 13 pumps or sucks the fluid (water). The pump body 10 includes an extension portion 17 that is formed in a cylindrical shape and that surrounds the impeller 13 from an outer periphery of the pump body 10. The whirl chamber 11 is configured by an internal space of the extension portion 17. The impeller 13 includes a circular plate 18 and plural blades 19. The circular plate 18 is fixed to the drive shaft 12. The blades 19 are vertically positioned from the circular plate 18 toward the cover case portion 20. Because the impeller 13 rotates by the drive shaft 12, the water stored in the whirl chamber 11 is pressure-fed, or pumped in an outer peripheral direction of the impeller 13.

The gasket portion 30 is provided with an intermediate plate 31, a first gasket 32 and a second gasket 33. The first gasket 32 is positioned at a first surface of the intermediate plate 31 (a surface facing the pump body 10). The second gasket 33 is positioned at a second surface of the intermediate plate 31 (a surface facing the cover case portion 20). The intermediate plate 31 is made from a high rigidity material, for example, any types of metals. The first and second gaskets 32, 33 are made from materials that include some degree of elasticity, for example, a synthetic resin or a relatively-hard rubber. Alternatively, the first and second gaskets 32, 33 correspond to, for example, metal gaskets being coated with a non-metal member, for example, a synthetic resin.

Figure 4:
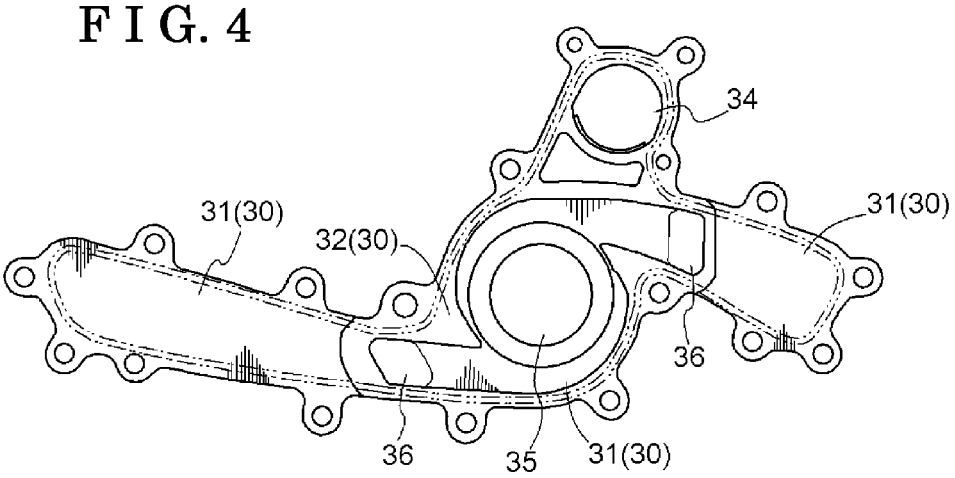
FIG. 4 is a front view of a gasket portion.
Figure 5:
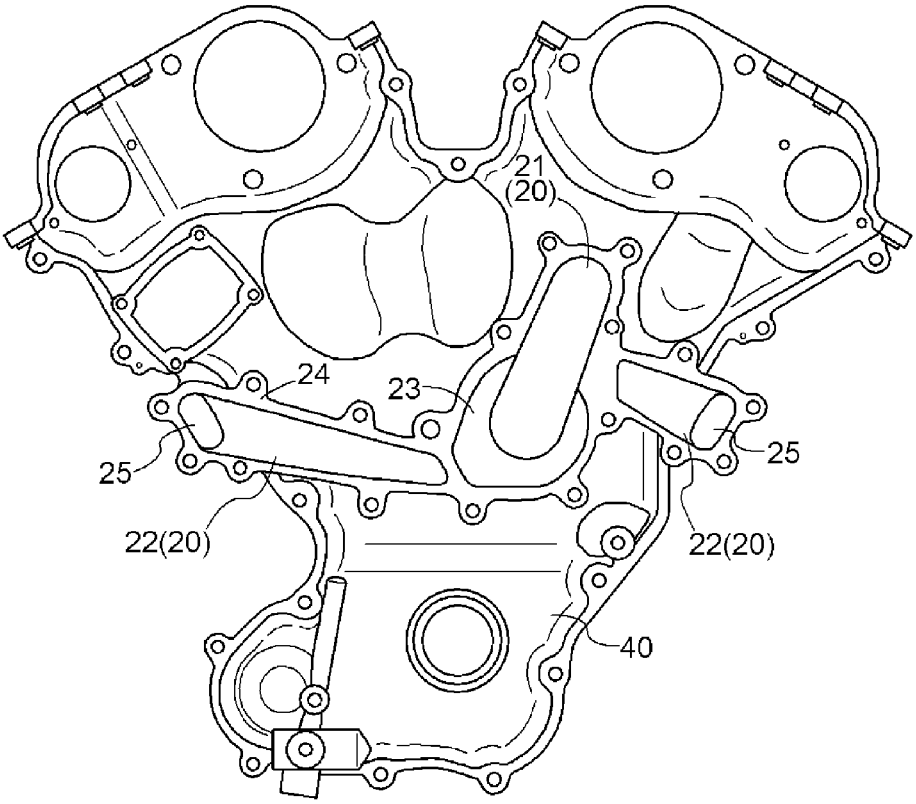
FIG. 5 is an exploded front view of the water pump according to the first embodiment.

As shown in FIG. 4, the intermediate plate 31 is provided with an entry hole 34 and an inlet hole 35. The fluid supplied via the tubular portion 16 enters into the inlet flow passage 21 via the entry hole 34. The inlet hole 35 being open from the whirl chamber 11 to the inlet flow passage 21 is positioned through the intermediate plate 31. An outlet hole 36 being open from the whirl chamber 11 to the outlet flow passage 22 is positioned through the intermediate plate 31. An inserting piece 37 (i.e., serving as an inclination portion) being bent toward the cover case portion 20 is positioned at a rim portion of the outlet hole 36.

Figure 6:
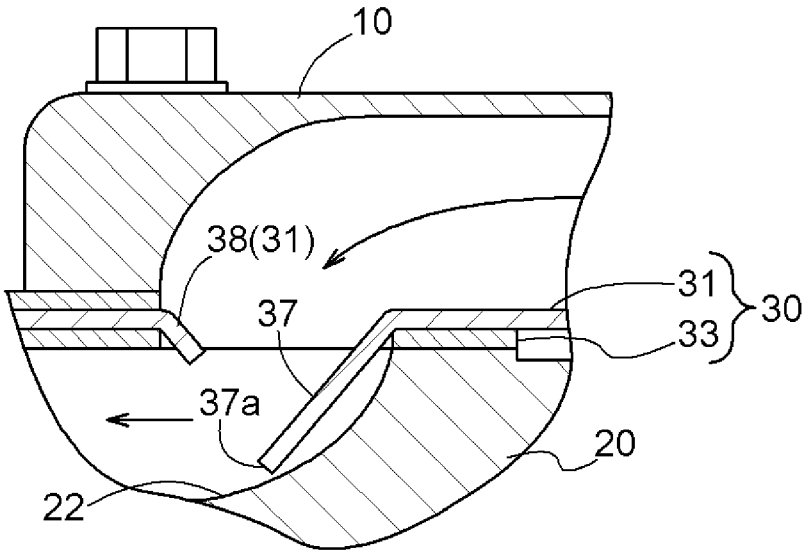
FIG. 6 is a cross sectional view of an essential portion being positioned close to an outlet opening portion.

The fluid (water) stored in the whirl chamber 11 flows to the outlet flow passage 22 via the outlet hole 36 and is sent from the outlet 25 to, for example, a water jacket of the engine. The outlet 25 is positioned through the cover case portion 20 and is communicated with the outlet flow passage 22. As shown in FIG. 6, the inserting piece 37 of the intermediate plate 31 includes the inclination portion that is bent and inserted into the outlet flow passage 22 in a manner to be inclined or tilted in a flow direction of the outlet flow passage 22 toward a distal end portion 37*a*. Because the inclination portion (the inserting piece 37) is formed, the fluid is easily discharged, or drained from the whirl chamber 11 to the outlet flow passage 22. Thus, for example, the distribution resistance, or the flow resistance is decreased and the discharging performance of the water pump 1 is enhanced.

The first gasket 32 is positioned at a peripheral rim of the intermediate plate 31 and at respective peripheral portions of the entering hole 34 and the outlet hole 35. The second gasket 33 is positioned at a portion facing the outlet flow passage 22. Thus, the gasket portion 30 separates the inlet flow passage 21 from the whirl chamber 11. A portion of the gasket portion 30 covers the outlet flow passage 22 in a state where the portion of the gasket portion 30 is exposed by not being in contact with the pump body 10.

The pump body 10 and the cover case portion 20 are attached with each other with, for example, bolts 50, in a state where the gasket portion 30 is positioned between the pump body 10 and the cover case portion 20. The portion of the gasket portion 30 covers the outlet flow passage 22 and is attached to the cover case portion 20 with, for example, the bolts 50.

The gasket portion 30 separates the pump body 10 from the cover case portion 20 to form the inlet flow passage 21 and the whirl chamber 11. Accordingly, the fluid (water) stored in the whirl chamber 11, the fluid being sent or pumped by the impeller 13, does not flow back to the inlet flow passage 21.

Because the outlet hole 36 is provided at the gasket portion 30 and because the portion of the gasket portion 30 covers the outlet flow passage 22, the pump body 10 (a pump cover) does not have to be provided at a portion for covering the outlet flow passage 22. Thus, the pump body 10 can be downsized, resulted in the downsizing of the water pump 1. As a result, because the weight of the water pump 1 is decreased, the fuel consumption is enhanced and the manufacturing cost of the water pump 1 can be reduced. Because the pump body 10 is downsized, the water pump 1 can be easily mounted or removed. Thus, the maintainability of the water pump 1 is enhanced.

As shown in FIG. 6, the gasket portion 30 includes a bending portion 38 bending toward the cover case portion 20, the bending portion 38 being provided at at least one portion of the rim portion of the outlet hole 36. The portion of the gasket portion 30 covers the outlet flow passage 22 in a state where the portion of the gasket portion 30 is exposed by not being in contact with the pump body 10. The pump body 10 is fixed to a portion of the gasket portion 30, the portion that covers the outlet flow passage 22 being close to the outlet hole 36 of the gasket portion 30. In this case, because the bending portion 38 of the gasket portion 30 covering the outlet passage 22 does not include an underlying support portion, the gasket portion 30 is easily bent and the sealing performance performed by the gasket portion 30 may be degraded. However, as described above, because the bending portion 38 facing the cover case portion 20 is positioned at the rim portion of the outlet hole 36 of the gasket portion 30, the rigidity of the gasket portion 30 is enhanced. Thus, because the gasket portion 30 is inhibited from being bent when the pump body 10 is fixed, a sufficient sealing performance is secured.

Figure 7:
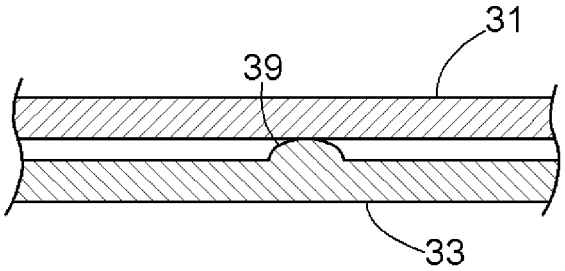
FIG. 7 is a cross sectional view of an essential portion (a bead portion) of a gasket.

As shown in FIG. 7, the second gasket 33 that is provided at a peripheral rim of the gasket portion 30 includes a bead 39. The bead 39 is for enhancing the fitness, or the adhesiveness of the second gasket 33 relative to the intermediate plate 31 that is in contact with the second gasket 33. However, according to the first embodiment, the intermediate plate 31 has a first portion that is sandwiched by the first and second gasket portions 32, 33, and a second portion that is in contact with the second gasket 33. Specifically, the second portion of the intermediate plate 31, the second portion that is only in contact with the second gasket 33, covers the outlet flow passage 22. The intermediate plate 31 and the second gasket 33 are easily separated from each other at the first portions, the first portions being fixed to the first gasket 32 and the second gasket 33 with the bolts 50. Thus, it is favorable that the height of the bead 39 of the second gasket 33 at a portion covering the outlet flow passage 22 and the height of the bead 39 at a position where the gasket portion 30 is sandwiched by the pump body 10 and the cover case portion 20 are optimized with each other. As a result, the fitness, or the adhesiveness of the intermediate plate 31 and the second gasket 33 is ensured. As a result, the sealing performance of the gasket portion 30 relative to the outlet flow passage 22 is enhanced.

Figure 8:
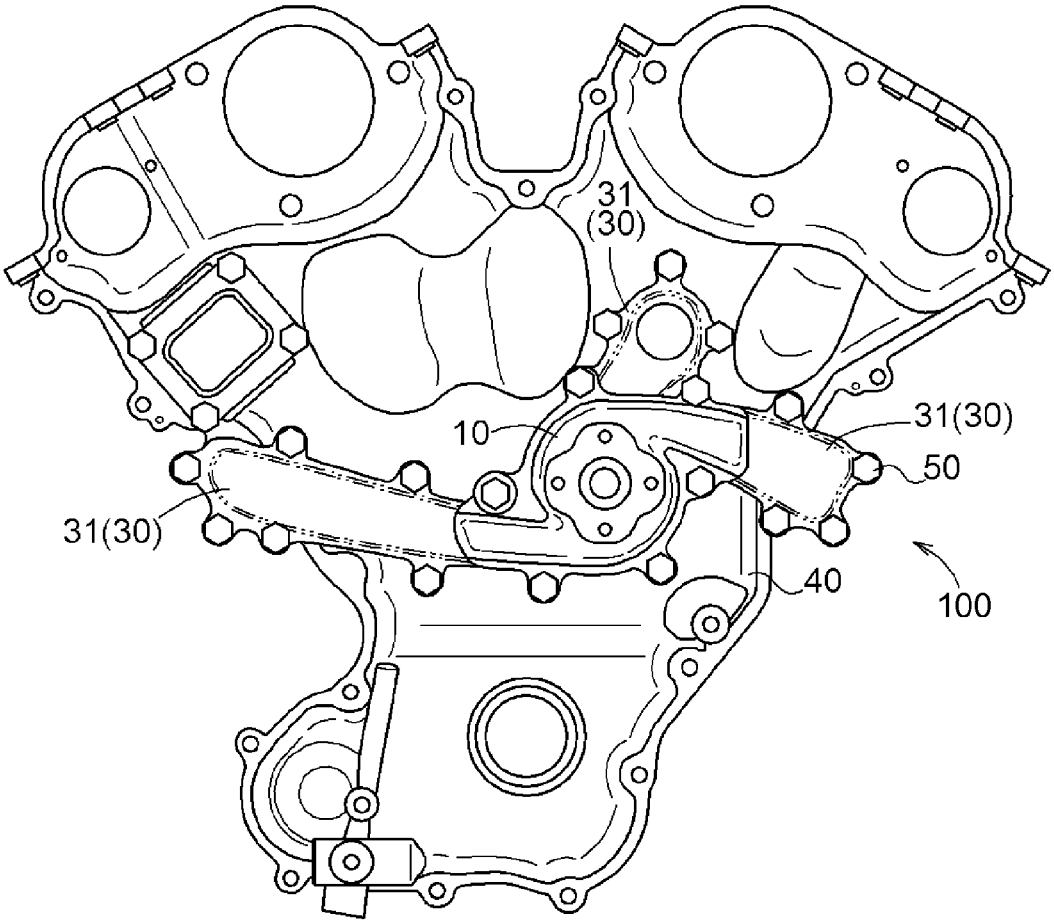
FIG. 8 is a front view of a water pump according to a second embodiment.

A second embodiment will hereunder be explained. According to a water pump 100 of the second embodiment shown in FIG. 8, the pump body 10 does not have to include the tubular portion 16 in which the fluid from outside is introduced to the inlet flow passage 21. In this case, the first gasket 32 is not positioned at a portion covering the inlet flow passage 21 in a state where the first gasket 32 is exposed from the pump body 10. A portion of the gasket portion 30 covers the inlet flow passage 21 and the outlet flow passage 22.

Thus, the gasket portion 30 can be effectively provided as the portion covering the water pump 100. Because the pump body 10 (the pump cover) does not have to include the portion covering the inlet flow passage 21 and the outlet flow passage 22, the pump body 10 may be further downsized. As a result, a die-cast machine forming the pump body 10 can be downsized.

Figure 9:
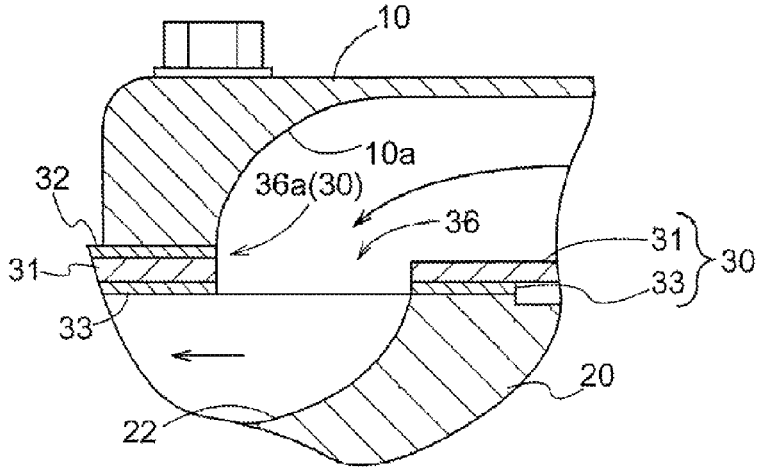
FIG. 9 is a cross sectional view of an essential portion being positioned close to an outlet opening portion according to a third embodiment.

According to a third embodiment of this disclosure, as shown in FIG. 9, a rim portion 36*a* of the outlet hole 36 of the gasket portion 30 is provided at a position where the rim portion 36*a* does not protrude from an inner surface 10*a* of the pump body 10. The inserting piece 37 and the bending portion 38 are cut off to form the outlet hole 36. In FIG. 9, the rim portion 36*a* of the outlet hole 36 is provided at a position along the inner surface 10*a* of the pump body 10. That is, the rim portion 36*a* of the outlet hole 36 is flush with the inner surface 10*a* of the pump body 10. Alternatively, the rim portion 36*a* of the outlet hole 36 is provided at a portion where the rim portion 36*a* is retracted from the inner surface 10*a* of the pump body 10. That is, the rim portion 36*a* of the outlet hole 36 has a step, or a level difference relative to the inner surface 10*a* of the pump body 10.

Because the rim portion 36*a* of the outlet hole 36 is provided at a position where the rim portion 36*a* does not protrude from the inner surface 10*a* of the pump body 10, the rim portion 36*a* of the outlet hole 36 that is retracted from the inner surface 10*a* of the pump body 10 does not have an effect on the flow of the fluid. As a result, the water pump 1 may operate effectively. In addition, because the rim portion 36*a* of the outlet hole 36 is not pushed by the fluid, the rim portion 36*a* does not generate a gap relative to the pump body 10. Accordingly, the leakage of the fluid does not occur.

According to the third embodiment, because the rim portion 36*a* of the gasket portion 30 does not have a bending portion, the thickness of the intermediate plate 31 is increased to enhance the rigidity. The gaskets 32, 33 correspond to metal gaskets. In a case where the thickness of the intermediate plate 31 is increased, the gaskets 32, 33 may be made from rubber materials and may be adhered to the intermediate plate 31. In this case, the number of the bolts 50 fixing the gasket portion 30 can be reduced. However, the process to adhere the gaskets 32, 33 is desired.

Figure 10:
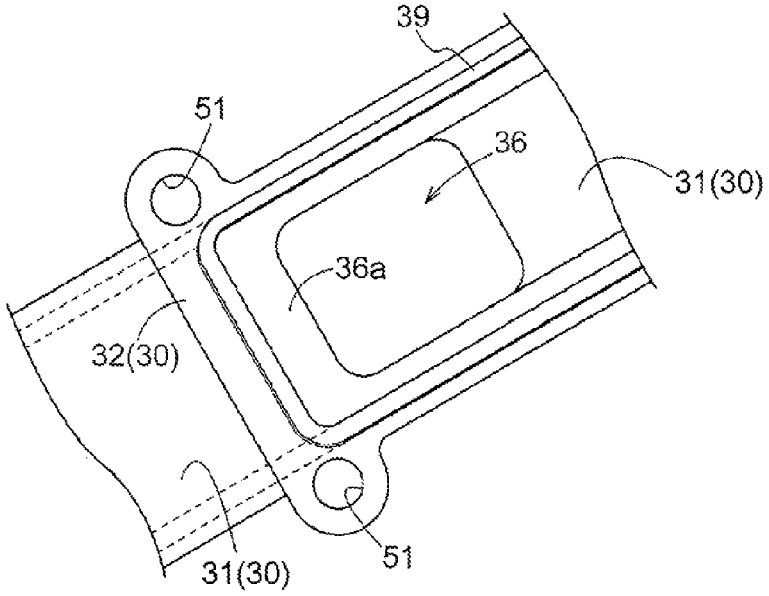
FIG. 10 is a plan view of a gasket being positioned close to the outlet opening portion of the third embodiment.

As shown in FIG. 10, the rim portion 36*a* of the outlet hole 36 is provided with the bead 39 at an upper portion of the first gasket 32. In a case where the pump body 10 is mounted on the gasket portion 30, the bead 39 is pressurized to enhance the sealing characteristics. The gasket portion 30 is provided with bolt holes 51 at opposing ends of the bead 39 in the width direction of the gasket portion 30. The bead 39 is positioned on a line that connects the two bolt holes 51. Thus, the rim portion 36*a* of the gasket portion 30 is susceptible to the fixing strength by the bolts 50, leading to the enhancement of the sealing characteristics. Because the sealing characteristics is enhanced, the outlet amount may be increased by the setting of the width of the outlet hole 36 wide, the outlet hole 36*a* of the gasket portion 30 being sandwiched by the bolt holes 51.

According to the aforementioned embodiment, the portion of the gasket portion 30 covers the outlet flow passage 22 in a state where the portion of the gasket portion 30 is exposed by not being in contact with the pump body 10, for example. According to the second embodiment, the portion of the gasket portion 30 covers the inlet flow passage 21 and the outlet flow passage 22, for example. Alternatively, the portion of the gasket portion 30 covers the inlet flow passage 21.

According to the first embodiment, the inserting piece 37 of the intermediate plate 31 forms, or defines the outlet hole 36, for example. Alternatively, according to the third embodiment, the outlet hole 36 serves as a through hole being formed by the cutting off of the inserting piece 37 and the bending portion 38. Alternatively, one of the inserting piece 37 and the bending portion 38 may be cut off to form the outlet hole 36.

Figure 11:
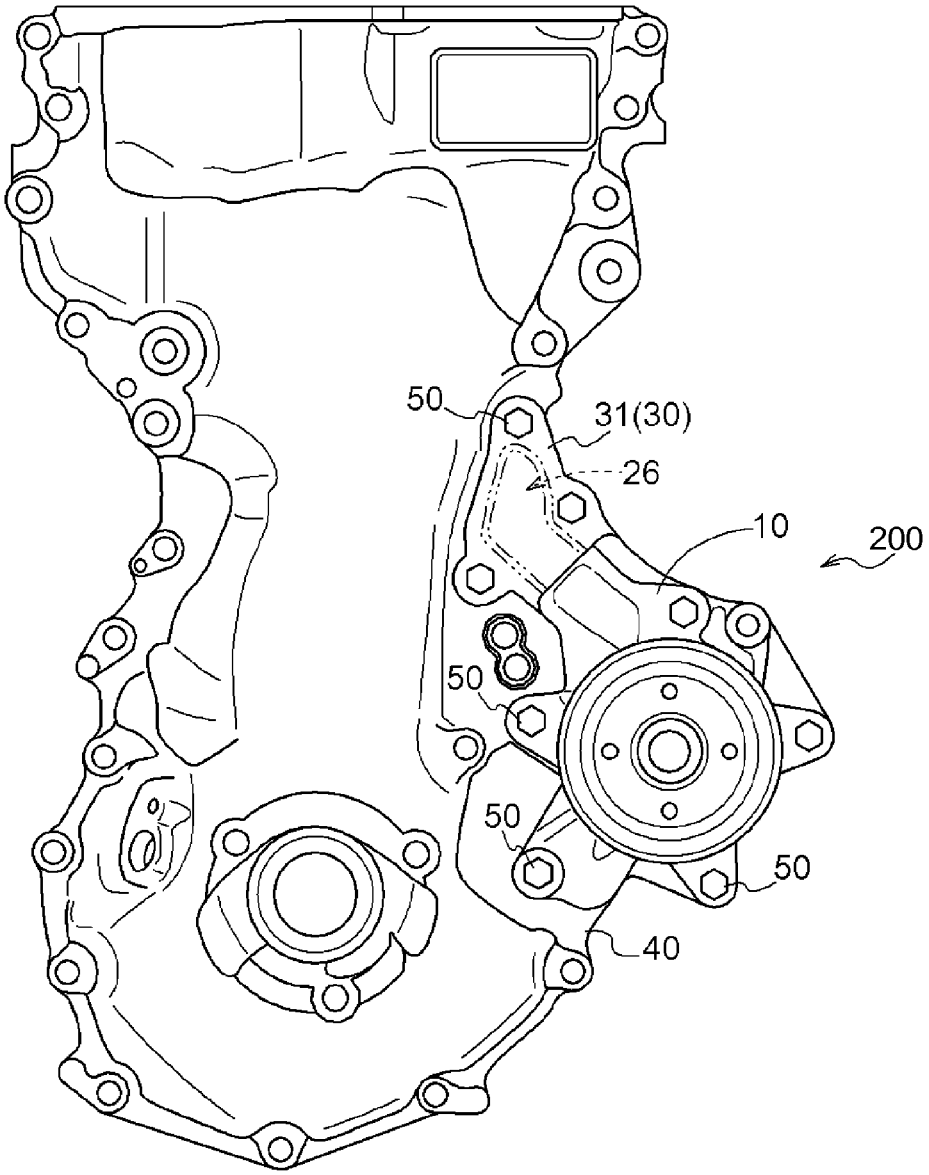
FIG. 11 is a front view of a water pump according to a fourth embodiment.

According to a fourth embodiment, as shown in FIG. 11, a water pump 200 includes a groove portion 26 that is positioned at a portion of the chain cover 40 and that serves as an outlet flow passage. In this case, the portion of the gasket portion 30 being extended from a side of the pump body 10 covers the groove portion 26.

The portion of the gasket portion 30 covering the outlet flow passage 22 is fixed to the cover case portion 20. The bolts 50 fixing the portion of the gasket portion 30 to the cover case portion 20 may have a space or an interval between the bolts 50 smaller than the other portion (the portion covered with the pump body 10). In a case where the bolts 50 include the space or interval between the bolts 50 smaller than the other portion, the sealing performance of the gasket portion 30 relative to the outlet flow passage 22 is enhanced.

The gasket portion 30 may include the thick intermediate plate 31. Because the intermediate plate 31 is thickened and because the thickness of the intermediate plate 31 is optimized, the rigidity of the intermediate plate 31 (the gasket portion 30) is enhanced. Thus, the sealing performance of the gasket portion 30 is enhanced.

According to the aforementioned embodiment, the bending portion 38 is provided at the rim portion of the outlet hole 36 of the gasket portion 30, for example. Alternatively, the bending portion 38 does not have to be provided at the rim portion of the outlet hole 36.

According to the aforementioned embodiment, the cover case portion 20 is configured by the portion of the chain cover 40, for example. Alternatively, the cover case portion 20 may serve as a portion of the cylinder block.

An industrial applicability will be explained. This disclosure is applicable to various kinds of water pumps that include a pump body, a mating member and a gasket portion. The pump body includes the impeller. The mating member, for example, a cover case portion, faces the pump body and includes an inlet flow passage. The gasket portion is positioned between the pump body and the mating member.

According to the aforementioned embodiments, the water pump (1, 100) includes the impeller (13) being rotary driven, the whirl chamber (11) containing the impeller (13), the pump body (10) including the impeller (13) and the whirl chamber (11), the cover case portion (20) being attached to the pump body (10) so as to face therewith, and the gasket portion (30) being positioned between the pump body (10) and the cover case portion (20). The cover case portion (20) is formed with the inlet flow passage (21) in which the fluid is introduced to the whirl chamber (11). The cover case portion (20) is formed with the outlet flow passage (22) in which the fluid is discharged from the whirl chamber. The gasket portion (30) is formed with the inlet hole (35) opening from the whirl chamber (11) to the inlet flow passage (21). The gasket portion (30) is formed with the outlet hole (36) opening from the whirl chamber (11) to the outlet flow passage (22). The gasket portion (30) includes a portion covering at least one of the inlet flow passage (21) and the outlet flow passage (22) in a state where the portion of the gasket portion (30) is exposed by not being in contact with the pump body (10).

According to the aforementioned construction, the gasket portion 30 includes the inlet hole 35 opening from the whirl chamber 11 to the inlet flow passage 21, and the outlet hole 36 opening from the whirl chamber 11 to the outlet flow passage 22. The portion of the gasket portion 30 covers at least one of the inlet flow passage 21 and the outlet flow passage 22 in a state where the portion of the gasket portion 30 is exposed by not being in contact with the pump body 10. Accordingly, the portion (pump cover) covering at least one of the inlet flow passage 21 and the outlet flow passage 22 of the pump body 10 does not have to be provided. Thus, the pump body 10 can be downsized, resulted in the downsizing of the water pump 1, 100. As a result, because the weight of the water pump 1, 100 is decreased, the fuel consumption is enhanced and the manufacturing cost of the water pump 1, 100 is reduced. Because the pump body 10 is downsized, the water pump 1, 100 can be easily mounted or removed. Thus, the maintainability of the water pump 1, 100 is enhanced.

According to the aforementioned embodiments, the gasket portion (30) is formed with the inclination portion (37) being provided at the rim portion of the outlet hole (36) of the gasket portion (30), the inclination portion (37) guiding the fluid to the outlet flow passage (22).

According to the aforementioned construction, because the gasket portion is formed with the inclination portion (the inserting piece 37) guiding the fluid to the outlet flow passage 22, the inclination portion (the inserting piece 37) being provided at the rim portion of the outlet hole 36 of the gasket portion 30, the fluid is easily discharged, or drained from the whirl chamber 11 to the outlet flow passage 22. Thus, for example, the distribution resistance, or the flow resistance is decreased and the discharging performance of the water pump 1, 100 is enhanced.

According to the aforementioned embodiments, the gasket portion (30) is formed with the bending portion (38) being provided at the rim portion of the outlet hole (36) of the gasket portion (30), the bending portion (38) bending toward the cover case portion (20).

According to the water pump 1, 100 of the embodiments, in a case where the portion of the gasket portion 30 covers the outlet flow passage 22 in a state where the portion of the gasket portion 30 is exposed by not being in contact with the pump body 10, the pump body 10 is fixed to the portion of the gasket portion 30, the portion that covers the outlet flow passage 22 being close to the outlet hole 36 of the gasket portion 30. In this case, because the bending portion 38 of the gasket portion 30 covering the outlet passage 22 does not include the underlying support portion, the gasket portion 30 is easily bent and the sealing performance performed by the gasket portion 30 may be degraded. However, as described above, because the bending portion 38 facing the cover case portion 20 is positioned at the rim portion of the outlet hole 36 of the gasket portion 30, the rigidity of the gasket portion 30 is enhanced. Thus, because the gasket portion 30 is inhibited from being bent when the pump body 10 is fixed, a sufficient sealing performance is secured.

According to the aforementioned embodiment, the outlet hole (36) of the gasket portion (30) includes the rim portion (36*a*) that is formed at a position where the rim portion (36*a*) does not protrude from the inner surface (10*a*) of the pump body (10).

According to the aforementioned construction, the rim portion 36*a* of the outlet hole 36 of the gasket portion 30 is provided at the position where the rim portion 36*a* does not protrude from the inner surface 10*a* of the pump body 10. Thus, the rim portion 36*a* of the outlet hole 36 that is retracted from the outlet flow passage 22 does not have the effect on the flow of the fluid. As a result, the water pump 1 may operate effectively. In addition, because the rim portion 36*a* of the outlet hole 36 is not pushed by the fluid, the rim portion 36*a* does not generate the gap relative to the pump body 10. Accordingly, the leakage of the fluid does not occur. Because the rim portion 36*a* of the outlet hole 36 does not protrude from the inner surface 10*a* of the pump body 10, the bending portion is not formed at the rim portion 36*a* of the outlet hole 36 for securing the rigidity of the gasket portion 30. However, the rim portion 36*a* of the outlet hole 36 may secure the rigidity by the control of materials or thickness of the intermediate plate 31.

According to the aforementioned embodiment, the water pump (200) includes the impeller (13) being rotary driven, the whirl chamber (11) containing the impeller (13), the pump body (10) including the impeller (13) and the whirl chamber (11), the chain cover (40) being attached to the pump body (10) so as to face therewith, and the gasket portion (30) being positioned between the pump body (10) and the chain cover (40). The chain cover (40) is formed with the inlet groove portion (the inlet flow passage 21) in which the fluid is introduced to the whirl chamber (11). The chain cover (40) is formed with the outlet groove portion (the outlet flow passage 22, the groove portion 26) in which the fluid is discharged from the whirl chamber (11). The gasket portion (30) is formed with the inlet hole (35) opening from the whirl chamber (11) to the inlet groove portion (the inlet flow passage 21). The gasket portion (30) is formed with the outlet hole (36) opening from the whirl chamber (11) to the outlet groove portion (the outlet flow passage 22, the groove portion 26). The gasket portion (30) includes a portion covering at least one of the inlet groove portion (the inlet flow passage 21) and the outlet groove portion (the outlet flow passage 22, the groove portion 26) in a state where the portion of the gasket portion (30) is exposed by not being in contact with the pump body (10).

According to the aforementioned construction, the gasket portion 30 includes the inlet hole 35 opening from the whirl chamber 11 to the inlet groove portion (the inlet flow passage 21), and the outlet hole 36 opening from the whirl chamber 11 to the outlet groove portion (the outlet flow passage 22). The portion of the gasket portion 30 covers at least one of the inlet groove portion (the inlet flow passage 21) and the outlet groove portion (the outlet flow passage 22) in a state where the portion of the gasket portion 30 is exposed by not being in contact with the pump body 10. Accordingly, the portion (pump cover) covering at least one of the inlet groove portion (the inlet flow passage 21) and the outlet groove portion (the outlet flow passage 22) of the pump body 10 does not have to be provided. Thus, the pump body 10 can be downsized, resulted in the downsizing of the water pump 200. As a result, because the weight of the water pump 200 is decreased, the fuel consumption is enhanced and the manufacturing cost of the water pump 200 is reduced. Because the pump body 10 is downsized, the water pump 200 can be easily mounted or removed. Thus, the maintainability of the water pump 200 is enhanced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A water pump, comprising:

an impeller being rotary driven;

a whirl chamber containing the impeller;

a pump body including the impeller and the whirl chamber;

a cover case portion being attached to the pump body so as to face therewith; and a gasket portion being positioned between the pump body and the cover case portion; wherein the cover case portion is formed with an inlet flow passage in which a fluid is introduced to the whirl chamber, the cover case portion is formed with an outlet flow passage in which the fluid is discharged from the whirl chamber;

the gasket portion is formed with an inlet hole opening from the whirl chamber to the inlet flow passage, the gasket portion is formed with an outlet hole opening from the whirl chamber to the outlet flow passage; and the gasket portion includes a portion covering at least one of the inlet flow passage and the outlet flow passage in a state where the portion of the gasket portion is exposed by not being in contact with the pump body.

2. The water pump according to claim 1, wherein the gasket portion is formed with an inclination portion being provided at a rim portion of the outlet hole of the gasket portion, the inclination portion guiding the fluid to the outlet flow passage.

3. The water pump according to claim 1, wherein the gasket portion is formed with a bending portion being provided at a rim portion of the outlet hole of the gasket portion, the bending portion bending toward the cover case portion.

4. The water pump according to claim 2, wherein the gasket portion is formed with a bending portion being provided at the rim portion of the outlet hole of the gasket portion, the bending portion bending toward the cover case portion.

5. The water pump according to claim 1, wherein the outlet hole of the gasket portion includes a rim portion that is formed at a position where the rim portion does not protrude from an inner surface of the pump body.

6. The water pump according to claim 2, wherein the outlet hole of the gasket portion includes a rim portion that is formed at a position where the rim portion does not protrude from an inner surface of the pump body.

7. A water pump, comprising:

an impeller being rotary driven;

a whirl chamber containing the impeller;

a pump body including the impeller and the whirl chamber;

a chain cover being attached to the pump body so as to face therewith; and a gasket portion being positioned between the pump body and the chain cover; wherein the chain cover is formed with an inlet groove portion in which a fluid is introduced to the whirl chamber, the chain cover is formed with an outlet groove portion in which the fluid is discharged from the whirl chamber;

the gasket portion is formed with an inlet hole opening from the whirl chamber to the inlet groove portion, the gasket portion is formed with an outlet hole opening from the whirl chamber to the outlet groove portion; and the gasket portion includes a portion covering at least one of the inlet groove portion and the outlet groove portion in a state where the portion of the gasket portion is exposed by not being in contact with the pump body.

* * * * *